US012227813B2

(12) United States Patent
Li et al.

(10) Patent No.: US 12,227,813 B2
(45) Date of Patent: Feb. 18, 2025

(54) DEGASSING METHOD FOR MANUFACTURING STEEL

(71) Applicant: United States Steel Corporation, Pittsburgh, PA (US)

(72) Inventors: Yun Li, Murrysville, PA (US); David L. Runner, Louisville, KY (US); Jonathan D. Youngblood, Southaven, MS (US); Scott R. Story, Pittsburgh, PA (US)

(73) Assignee: United States Steel Corporation, Pittsburgh, PA (US)

( * ) Notice: Subject to any disclaimer, the term of this patent is extended or adjusted under 35 U.S.C. 154(b) by 0 days.

(21) Appl. No.: 18/132,521

(22) Filed: Apr. 10, 2023

(65) Prior Publication Data

US 2023/0323492 A1 Oct. 12, 2023

Related U.S. Application Data

(63) Continuation-in-part of application No. 17/897,824, filed on Aug. 29, 2022.

(Continued)

(51) Int. Cl.

*C21C 7/068* (2006.01)
*C21C 5/52* (2006.01)

(Continued)

(52) U.S. Cl.

CPC ..... *C21C 7/068* (2013.01); *C21C 5/52* (2013.01); *C21C 7/0075* (2013.01); *C21C 7/06* (2013.01); *C21C 7/064* (2013.01); *C22C 38/004* (2013.01)

(58) Field of Classification Search

CPC ..... C21C 7/068; C21C 5/52; C21C 7/0075; C21C 7/06; C21C 7/064;

(Continued)

(56) References Cited

U.S. PATENT DOCUMENTS 6,355,205 B1 3/2002 Orito et al.
2010/0024596 A1 2/2010 Geldenhuis et al.

(Continued)

FOREIGN PATENT DOCUMENTS

EP 3147376 A1 3/2017
JP 07150220 A 6/1995

(Continued)

OTHER PUBLICATIONS

Satyendra, "Ladle Metallurgy", ISPAT Guru, Apr. 23, 2014 (Year: 2014).*

(Continued)

*Primary Examiner* — Brian D Walck
*Assistant Examiner* — Danielle Carda
(74) *Attorney, Agent, or Firm* — Alan G. Towner; Leech Tishman Fuscaldo & Lampl

(57) ABSTRACT

A method of making non-grain oriented (NGO) electrical steel is disclosed. The method includes tapping liquid steel out of a primary steelmaking furnace, deoxidizing the liquid steel before or after transferring the deoxidized liquid steel to a ladle metallurgy furnace, removing sulfur at the ladle metallurgy furnace (LMF), adding fluxes and deoxidizer to the ladle slag and/or skimming off ladle slag to prevent sulfur reversion, transferring the deoxidized liquid steel from the ladle metallurgy furnace to an RH degasser for carbon removal by blowing oxygen, and adding fluxes at the RH degasser before oxygen blowing to fortify the bottom layer of the ladle slag to prevent sulfur reversion. The removal of oxygen and sulfur prior to transferring the liquid steel to the RH degasser facilitates nitrogen removal and prevents carbon pick up during the step of adding fluxes and arcing for sulfur removal. Oxygen blowing at the RH also lowers titanium pickup. The ultra low levels of carbon, (Continued)

nitrogen, sulfur, and titanium in the NGO steel provide excellent magnetic properties.

11 Claims, 4 Drawing Sheets

Related U.S. Application Data

(60) Provisional application No. 63/237,636, filed on Aug. 27, 2021.

(51) Int. Cl.

| | |
|---|---|
| ***C21C 7/00*** | (2006.01) |
| ***C21C 7/06*** | (2006.01) |
| ***C21C 7/064*** | (2006.01) |
| ***C22C 38/00*** | (2006.01) |

(58) Field of Classification Search

CPC ..... C21C 2007/0093; C21C 7/0087; C21C 7/072; C21C 7/10; C22C 38/004

USPC ..... 420/129

See application file for complete search history.

(56) References Cited

U.S. PATENT DOCUMENTS

| | | | |
|---|---|---|---|
| 2010/0276102 | A1 | 11/2010 | McQuillis et al. |
| 2019/0062854 | A1 | 2/2019 | Sosinsky et al. |
| 2023/0093078 | A1 | 3/2023 | Li et al. |

FOREIGN PATENT DOCUMENTS

| | | | |
|---|---|---|---|
| JP | 2001271147 | A | 10/2001 |
| JP | 2004156083 | A | 6/2004 |
| JP | 2005336503 | A | 12/2005 |
| JP | 2010116611 | A | 5/2010 |
| KR | 101119022 | B1 | 3/2012 |
| WO | 2011156858 | A1 | 12/2011 |

OTHER PUBLICATIONS

Britannica, "Secondary Steelmaking", Jul. 19, 2019 (Year: 2019).*

Van Ende et al. "A Kinetic Model for the Ruhrstal Heraeus (RH) Degassing Process", Metallurgical and Materials Transactions, vol. 42B, Jun. 2011 (Year: 2011).*

Total Materia, "Ultra Low Carbon Interstitial Free Steels", Aug. 2015 (Year: 2015).*

Li et al., Impacts of Modification of Alloying Method on Inclusion Evolution in RH Refining of Silicon Steel, MDPI Materials, Oct. 19, 1017 (Year: 2017).*

Takahashi et al., "Mechanism of Decarburization in RH Degasser", ISIJ International (Japan) vol. 35, Iss. 12, (1995): 1452-1458.

Nakayama et al., "Effects of aluminum and nitrogen on the magnetic properties of non-oriented semi-processed electrical steel sheet", Journal of Magnetism and Magnetic Materials 213 (2000): 87-94.

Nakayama et al., "Effects of manganese and sulfur contents and slab reheating temperature on the magnetic properties of non-oriented, semi-processed electrical steel sheet", Journal of Magnetism and Magnetic Materials 223, (2001): 55-61.

Oda et al., "Ultra-low Sulfur Non-oriented Electrical Steel Sheets for Highly Efficient Motors: NKB-Core", NKK Technical Review, No. 87, Jan. 1, 2002, pp. 12-18.

Oda et al., "The effects of sulfur on magnetic properties of non-oriented electrical steel sheets"; Journal of Magnetism and Magnetic Materials, 254-255, (2003): 361-363.

Ou et al., "Desulfurization by Powder Top Injection Process in RH Degasser", AISTech 2005, vols. I & II and ICS 2005 Conference Proceedings; vol. I, vol. I & II, (May 9, 2005).

Hou, "Effects of sulfur content and slab reheating temperature on the magnetic properties of fully processed nonoriented electrical steels", Journal of Magnetism and Magnetic Materials 320 (2008): 1115-1122.

International Search Report and Written Opinion received for PCT Application Serial No. PCT/US2022/075611 dated Mar. 2, 2023, 12 pages.

* cited by examiner

DEGASSING METHOD FOR MANUFACTURING STEEL

CROSS-REFERENCE TO RELATED APPLICATIONS

This application is a continuation-in-part of U.S. patent application Ser. No. 17/897,824 filed Aug. 29, 2022, which claims the benefit of U.S. Provisional Patent Application Ser. No. 63/237,636 filed Aug. 27, 2021, both of which are incorporated herein by reference.

BACKGROUND INFORMATION

Typically, vacuum degassers utilized in the steel industry are either a Ruhrstale and Heraeus (RH) degasser or a Vacuum Tank Degasser (VTD). The RH degasser may be used for carbon removal and the tank degasser may be used for nitrogen and sulfur removal. The liquid steel tapped out of an Electric Arc Furnace (EAF) may contain higher contents of nitrogen and sulfur compared to that of a Basic Oxygen Furnace (BOF). As such, plants utilizing an EAF may choose to install a tank degasser, and BOF plants may choose to install an RH degasser.

The vacuum processes conducted outside a primary steelmaking furnace may be utilized to further remove carbon and decrease the solubility of hydrogen and nitrogen by lowering the partial pressures of CO, $H_2$, and $N_2$. Because of its high carbon removal efficiency, an RH degasser may be installed in shops intended for mass production of ultra-low carbon steel products. However, conventional RH degasser process has essentially no capability to remove sulfur and has very limited capability to remove nitrogen. Even if auxiliary equipment such as those to enable powder injection is installed at the RH degasser, the sulfur removal capability is very limited.

The intensifying global effort to reduce carbon dioxide emission has tremendous impact on the electrical steel market and manufacturing. As a result, the demand for electrical steel, especially electrical steel grades with low core loss and high permeability, is increasing at a very rapid pace. Electrical steel includes Grain-oriented (GO) and Non-grain-oriented (NGO) or Non-oriented (NO) steels. Grain-oriented steel is normally used in static equipment such as transformers. Non-grain-oriented steel is normally used in rotating equipment such as motors and generators. The electrification of the transportation worldwide, for example, means that internal combustion engines are steadily being replaced by electrical motors. High grade NGO are used in those motors to increase the energy efficiency.

The steel industry is also working to reduce carbon dioxide emission. Transitioning steelmaking from the traditional blast furnace+basic oxygen furnace (BF+BOF) to electric arc furnace (EAF) can reduce the $CO_2$ emmison by 60% to 90%, depending on the feed materials of the EAF and the source of the electricity, and many steel companies around the world are doing just that. However, the production of electrical steel is dominated by the BF+BOF process route plants due to the stringent requirement on control of residual elements in electrical steel. The present disclosure provides a method to produce electrical steel with ultra-low levels of residual elements such as carbon, nitrogen, sulfur, and oxygen required in high-grade NGO steel in an EAF steelmaking shop.

SUMMARY

A method of making NGO steel A method of making non-grain oriented (NGO) steel, comprising the steps of; tapping the liquid steel out of an EAF furnace; deoxidizing the liquid steel before or after transferring the liquid steel to a ladle metallurgy furnace; removing sulfur at the ladle metallurgy furnace; skimming off ladle slag and/or adding fluxes to the ladle slag to prevent sulfur reversion; transferring the desulfurized liquid steel from the ladle metallurgy furnace to a RH degasser; removing nitrogen from the desulfurized and deoxidized liquid steel at the RH degasser with fast vacuum pump down; adding fluxes into the vacuum vessel to fortify the bottom layer of the ladle slag against sulfur reversion; removing carbon by oxygen blowing and prevents carbon pick up during the step of adding fluxes and arcing for sulfur removal if sulfur removal is carried out at the LMF after carbon removal at the RH degasser in the conventional process; adding alloys to achieve chemistry specifications of the NGO steel; and recirculating the steel at the RH to remove inclusions.

A NGO steel sheet product comprising as low as less than 0.003 wt. % weight percent carbon, 0.003 weight percent nitrogen and 0.003 weight percent sulfur, wherein the steel product has been subjected to deoxidation and sulfur removal at a ladle metallurgy furnace prior to decarbonization at an RH degasser thereby preventing carbon pickup during sulfur removal.

A method of making NGO steel product comprising as low as less than 0.003 weight percent carbon, 0.003 weight percent nitrogen and 0.003 weight percent sulfur, the method comprising; tapping the liquid steel out of a BOF furnace; transferring the liquid steel to a ladle metallurgy furnace; removing sulfur from the liquid steel in the ladle metallurgy furnace; skimming off ladle slag and/or adding fluxes to the ladle slag to prevent sulfur reversion at the ladle metallurgy furnace; and transferring the liquid steel from the ladle metallurgy furnace to an RH degasser for carbon removal, wherein the removal of oxygen and sulfur prior to transferring the liquid steel to the RH degasser facilitates nitrogen removal and prevents carbon pick up during the step of removing sulfur.

DETAILED DESCRIPTION

Figure 1:
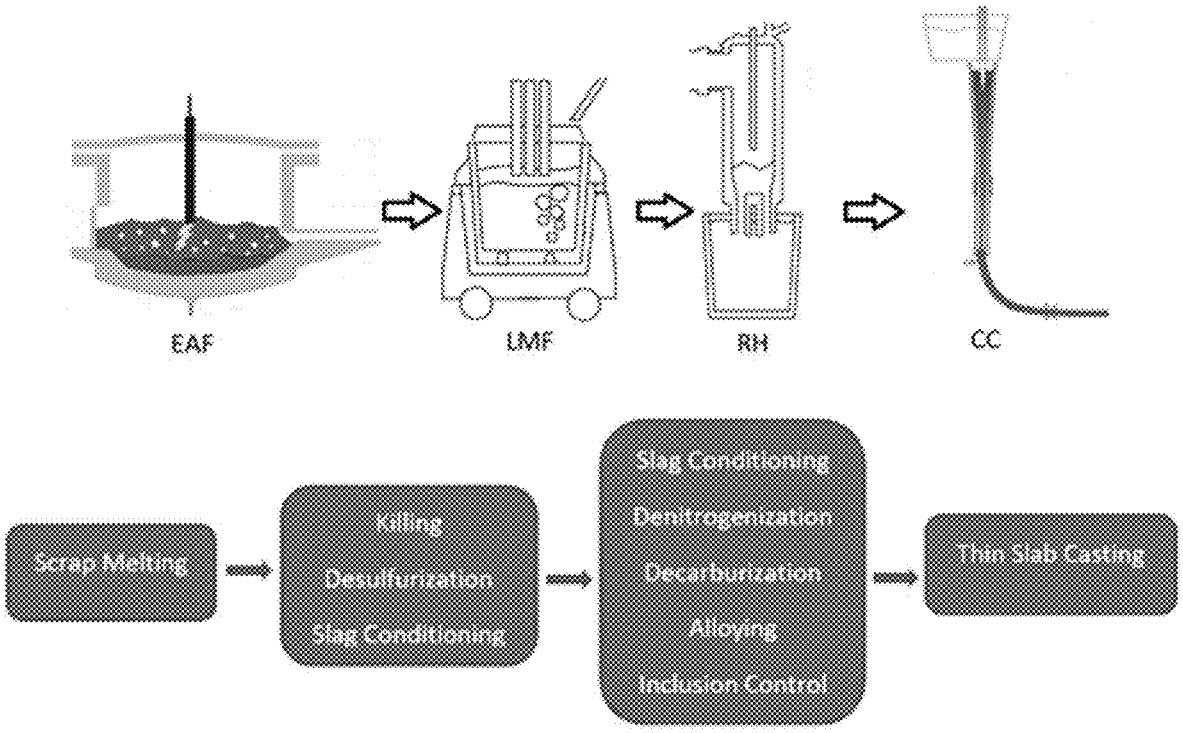
FIG. 1 shows a process flow chart according to an embodiment of the present disclosure.

Compared to the BF+BOF route, liquid steel tapping out of an EAF in general contains a higher concentration of nitrogen and sulfur. Depending on the scrap market conditions and availability of various metallic charge materials, it is often advantageous from a cost standpoint for an EAF steel shop to tap out steel with relatively high sulfur and nitrogen. In the BF+BOF route, the combination of deep desulfurization in hot metal pretreatment and scrap selection can lower the sulfur content in the liquid steel tapping out of the BOF around 0.005% or even lower. At the RH degasser, with the powder injection either through the top lance or the tuyeres, or bulk flux addition, it is possible to remove a few tens of ppms of sulfur, to achieve the ultra-low sulfur required in NGO steel grades. However, the sulfur content in liquid steel tapping out of an EAF is generally around 0.025% or even higher. To rely on the sulfur removal at the RH degasser to achieve the ultra-low sulfur levels is very difficult, if not impossible in an EAF shop. For nitrogen, the liquid steel tapping out of the BOF is generally between 20 to 30 ppm, and hence no nitrogen removal is necessary in the downstream secondary steelmaking steps. Nitrogen control in the EAF steelmaking has improved significantly in the past few decades, but even with the best practices the nitrogen level in the liquid steel tapping out of EAF are in the 40 ppm level, and normally expensive scrap mix is needed to achieve such low nitrogen content. Therefore, nitrogen removal is necessary in an EAF shop to produce high grade NGO steels. The present disclosure provides a method to efficiently remove sulfur and nitrogen in an EAF shop to produce high grade NGO steel using the EAF→LMF→RH→CC route, as shown in FIG. 1.

The present disclosure provides a method to produce NGO steel with ultra-low carbon (as low as less than 30 ppm), ultra-low nitrogen (as low as less than 30 ppm), and ultra-low sulfur (as low as less than 30 ppm), possible through a RH degasser, even from liquid steel tapped out of EAF with high levels of sulfur and nitrogen.

The present disclosure includes a method of using the LMF to remove large amounts of sulfur prior to vacuum decarburization at the RH and utilizes techniques to prevent and/or minimize sulfur reversion from the slag to the steel during RH treatment. Ultra-low sulfur in steel produced using this method ensures an extremely low concentration of sulfide based inclusions in the steel and hence lowers the core loss and improves the permeability of the NGO steel.

The present disclosure utilize the ultra-low sulfur level achieved at the LMF to accelerate nitrogen removal at the degasser. Therefore, significant amount of nitrogen can be removed at the RH degasser and that enables the production of ultra-low nitrogen steel even from the higher nitrogen levels in liquid steel tapping out of an EAF furnace. The ultra-low nitrogen in steel produced using this disclosure ensures low nitride-based inclusion concentration in the steel and hence lowers the core loss and improves the permeability of the NGO steel.

The present disclosure uses oxygen blowing to introduce oxygen into liquid steel that was deoxidized before the RH treatment to achieve carbon removal under vacuum. The ultra-low carbon in steel produced using this disclosure prevents age hardening of the NGO steel as well as core loss increase due to carbide formation.

The present disclosure utilize the RH degasser for inclusion control to produce clean steel with ultra-low total oxygen content to achieve the low core loss and high permeability required in high grade NGO steel.

The ultra-low sulfur in the liquid steel and the low oxygen content of the steel (killed steel) arriving at the RH degasser may enable rapid nitrogen removal at the RH degasser under vacuum. It may also enable fast pump down, e.g., as fast as the vacuum system can do, without steel splashing which often occurs in the RH vessel in the conventional RH treatment with open (unkilled) heat. When carbon removal is desired, oxygen may be blown through the top lance or side tuyeres into the heat. Once the aluminum in the steel is removed by oxygen, decarburization may follow. The oxygen blow/injection may be controlled such that the dissolved oxygen level in the liquid steel is high enough that the decarburization reaction will not be hindered, but low enough to not to promote sulfur reversion from the slag. That level may be around 200 ppm dissolved oxygen in the liquid steel. A model was developed to calculate the volume of oxygen blowing. Inputs of the model include steel mass, carbon, aluminium and silicon contents in the steel, and aim carbon content in the steel. The oxygen blowing may be divided into two or more batches to control the peak dissolved oxygen level in the steel. Following decarburization, the heat may be killed and alloys containing manganese, silicon, aluminum, chromium, etc., may be added into the RH degasser vessel to achieve desired steel grade chemistry specifications. Sufficient recirculation time in the RH before and after the alloy addition may allow inclusion floatation to produce clean steel. Depending on the type of caster, further treatment such as calcium treatment for thin slab caster may be desirable before sending the heat to the caster.

Deoxidizing the liquid steel may be accomplished before or after transferring the steel to a LMF to remove sulfur. In various embodiments of the present disclosure the heat does not have to be oxidized (not killed) for vacuum decarburization: it may be killed (for sulfur removal) and then blown "open" (using, for example, top blown oxygen) for vacuum decarburization. Embodiments of the present disclosure may make it possible to produce steel with ultra-low carbon (as low as less than 30 ppm), ultra-low nitrogen (for example as low as less than 30 ppm), and ultra-low sulfur (for example as low as less than 30 ppm), consistently and rapidly through an RH degasser, even from liquid steel tapped out of the primary steelmaking furnace with high levels of sulfur and nitrogen such as those from an EAF furnace.

In various embodiments of the present disclosure, a process to remove sulfur from steel before carbon removal in the degasser may be used to prevent carbon pickup from flux materials added for sulfur removal and from electrode during arcing in the process that removes sulfur after carbon removal at the RH degasser.

In various embodiments of the present disclosure the LMF may be used to remove sulfur prior to vacuum decarburization. This process may result in: (1) a larger amount of sulfur (e.g., a few hundreds of ppm) may be removed; and (2) distribution of the two functions (sulfur removal and carbon removal) at two facilities that can operate in parallel or concurrently (LMF and RH) and hence increased shop productivity. Embodiments of the present disclosure may allow cheaper EAF scrap mix than that otherwise required to tap out lower sulfur steel.

Embodiments of the present disclosure utilize techniques to prevent/minimize sulfur reversion from the slag to the steel during subsequent decarburization. Embodiments of the present disclosure utilize the ultra-low sulfur level achieved at the LMF to accelerate nitrogen removal at the degasser. Therefore, a significant amount of nitrogen may be removed at the RH degasser to produce ultra-low nitrogen steel even from liquid steel with higher nitrogen levels such as those tapped out of an EAF furnace. Embodiments of the present disclosure may allow cheaper EAF scrap mix than that otherwise required to tap out lower nitrogen steel. Embodiments of the present disclosure may shorten the tap to cast time and hence reduce energy consumption (less electrical arcing at the LMF) and reduce the ladle refractory consumption.

An RH degasser may be installed in a BOF shop in which the liquid steel tapped from the BOF contains a lower sulfur level (e.g., less than 0.01 wt. % and as low as less than 0.003 wt. % comparing to over 0.02 wt. % and as high as over 0.03 wt. % from an EAF), and lower nitrogen level and hence sulfur and nitrogen removal may not be necessary; In prior processes, sulfur removal in RH may be possible by flux addition or injection when ultra-low sulfur is desired. The amount of sulfur removal may be limited and it may be difficult to use a starting sulfur level as high as those tapped from an EAF. The fluxes may contain a high percentage of calcium fluoride ($CaF_2$) which are detrimental to the life of RH degasser refractories: the lower vessel and snorkel may last only for, for example, 2-3 heats.

Oxygen blowing/injection may be utilized with an RH degasser to accelerate decarburization or to increase steel temperature.

Table 1 shows the average and standard deviation of C, N, S and Ti in lower grade electrical steel (Cold Rolled Motor Lamination or CRML steel) heats made using a prior process. The average carbon, nitrogen, and sulfur in the liquid steel as measured from samples taken from the steel ladle after tapping from the EAF are 0.0286%, 0.0042%, and 0.0231%. Higher percentages of pig iron and HBI are used in the EAF to make those grades. As a result, the 0.0042% average nitrogen is lower than that in other steel grades in which nitrogen is not critical. Higher percentages of those "virgin" materials normally means higher cost.

TABLE 1

Average and standard deviation of C, S, N, and Ti in low grade electrical steel made using previous process (EAF-LMF-RH-LMF-CC)

| Sample LOC | C | S | N | Ti |
|---|---|---|---|---|
| EAF Avg | 0.0286 | 0.0231 | 0.0042 | 0.0002 |
| EAF Std | 0.0065 | 0.0051 | 0.0023 | 0.0002 |
| After RH Avg | 0.0014 | 0.0232 | 0.0050 | 0.0005 |
| After RH Std | 0.0009 | 0.0054 | 0.0012 | 0.0003 |
| LMF Final Avg | 0.0039 | 0.0013 | 0.0052 | 0.0021 |
| LMF Final Std | 0.0014 | 0.0011 | 0.0018 | 0.0007 |
| Caster Avg | 0.0051 | 0.0011 | 0.0055 | 0.0022 |
| Caster Std | 0.0025 | 0.0006 | 0.0021 | 0.0007 |

Figure 3:
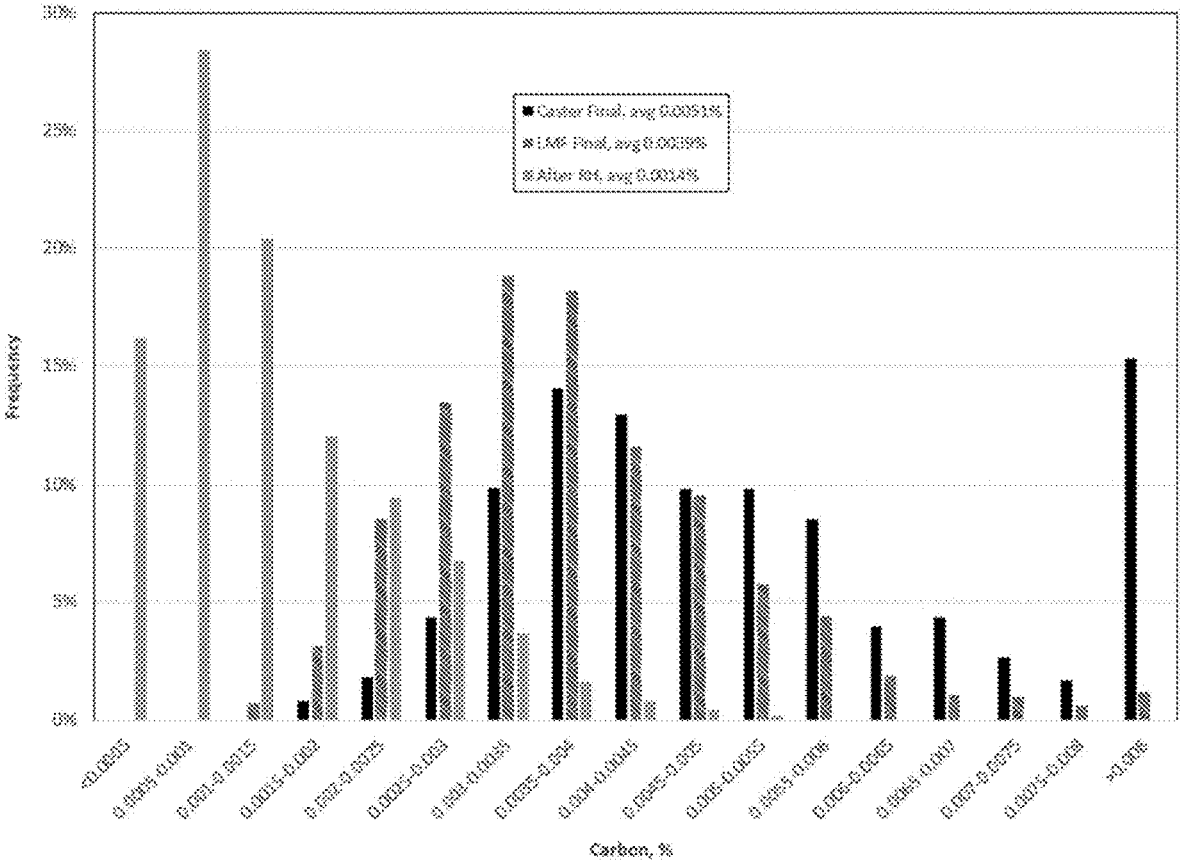
FIG. 3 shows a distribution of carbon content in CRML steel heats made using the prior art with EAF-LMF-RH-LMF-CC route.

For carbon, as the RH degasser is very efficient for carbon removal, the average carbon content in liquid steel after the RH degasser treatment, as measured in the first sample taken at the LMF after the heat returned to the LMF, is 0.0014% with a standard deviation of 0.0009%. As shown in FIG. 3, in 97% of the heats the carbon was lowered to below 0.0034%. However, in the LMF process after the heat was returned to the LMF, significant amount of carbon pickup occurred as demonstrated in Table 1 and FIG. 3. Potential sources of carbon pickup include flux additions, ladle refractory, and carbon electrode (during arcing). It may be pointed out that measures, such as heating the heat at the RH Degasser to a relatively high temperature to minimize the arcing after the heat is returned to the LMF for the second time, and not to use calcium carbide ($CaC_2$) for sulfur removal, have been in place in the attempt to minimize the carbon pickup. As also shown in Table 1 and FIG. 3, there is an additional 0.0012%, on average, of carbon pickup from the LMF to the caster which certainly needs to be improved. In only 16% of the CRML heats the final carbon level is below 0.0034% with this process route Such performance is certainly not acceptable for high grade NGO steel production using the prior art.

Figure 4:
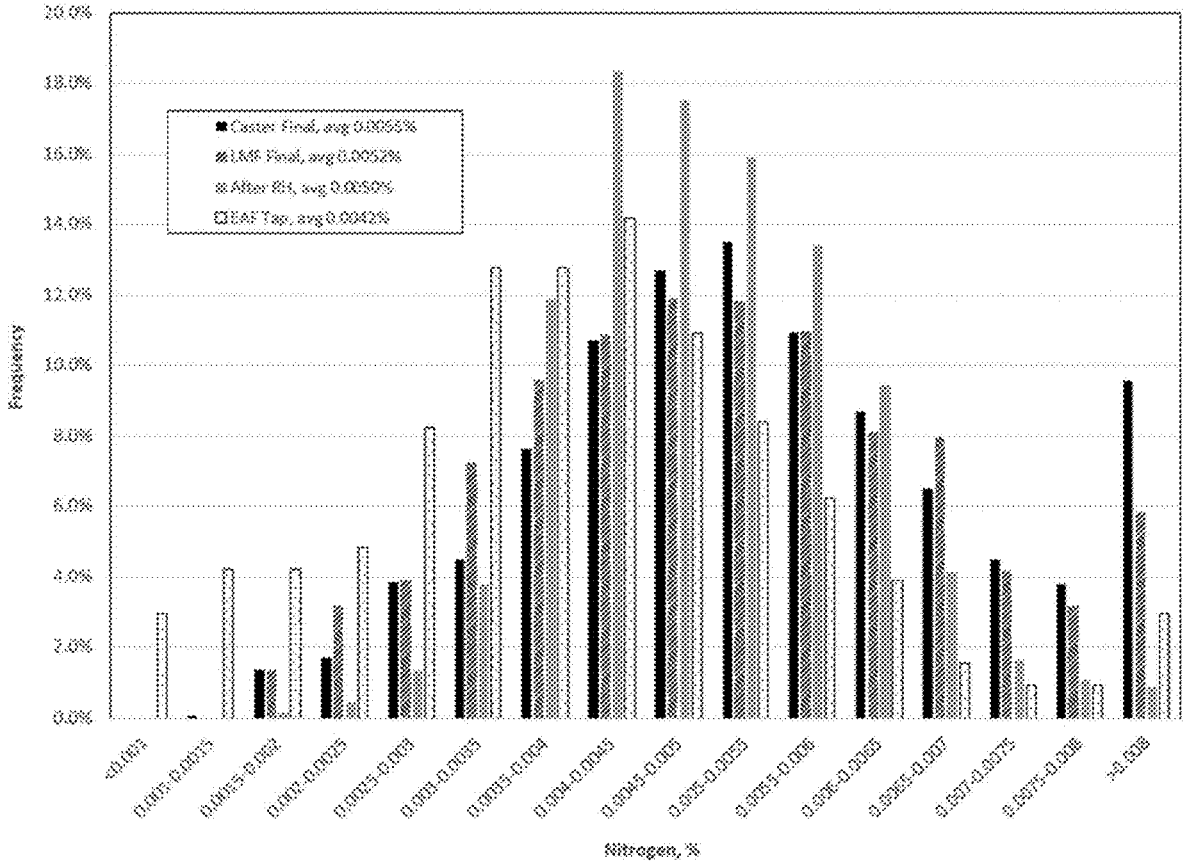
FIG. 4 shows FIG. 4. Distribution of nitrogen content in CRML steel heats made using prior art with EAF-LMF-RH-LMF-CC route.

For nitrogen, as shown in Table 1 and FIG. 4, its content steadily increased throughout the process. There is no nitrogen removal but a slight pickup from the RH treatment. This is expected as the sulfur in the steel is so high it would prevent nitrogen removal under vacuum at the RH degasser. Before taking the sample at the LMF after processing at the RH had been completed, strong stirring had to be employed to break the slag crust so there may be a slight nitrogen pickup from that. In only 11% of the CRML heats the final nitrogen level is below 0.0034%. Such performance is certainly not acceptable for high grade NGO steel production using the prior art For sulfur, there is no removal during the first round of the LMF treatment and the RH treatment as demonstrated in Table 1. When the heat returned to the LMF, flux additions and strong stirring were applied to remove sulfur. There is higher silicon (Si) and aluminum (Al) concentration in CRML grade steel than in most other grades which also promotes the sulfur removal. The sulfur was lowered to 0.0013% on average. The sulfur level remains steady, with a very slight drop, from the LMF to the caster as shown in Table 1. Overall, the sulfur performance is excellent even for high grade NGO steel production.

Titanium (Ti) is another important residual elements to be controlled in electrical steel. Residual titanium in electrical steel forms small precipitates in the final products that are detrimental to the electrical steel properties—namely, increased core loss and decreased magnetic permeability. As shown in Table 1, titanium in the CRML steel made using the prior art increased significantly from the after RH sample to the final LMF sample. As a residual element, titanium may be introduced into the steel with other alloys such as ferrosilicon or it may be reverted to the steel from the slag due to the reduction of titanium oxide in the slag during desulfurization. With the prior art, desulfurization was carried out after the RH treatment, that resulted in significant increase in titanium content in the liquid steel as shown in Table 1. In the embodiments of the present disclosure, oxygen blowing at the RH degasser, which occurs after the desulfurization of the steel at the LMF, oxidizes and hence lowers the content of titanium in the steel from the prior desulfurization step. That is another advantage of the present disclosure.

The following examples are intended to illustrate various aspects of the present disclosure, and are not intended to limit the scope of the disclosure.

Example 1—Heat #2201684

The general process after the heat was tapped out of the EAF furnace follows the six steps described above.

In this particular heat, the final EAF celox measurement showed 3099° F. and 624 ppm dissolved oxygen for the liquid steel in the EAF furnace. The 163 short ton heat was tapped out of the EAF, without any additions during tapping, at 10:01 AM on Feburary 10th, 2022. The heat was then sent to the LMF. Argon stirring from both two porous plugs in the steel ladle were initiated when the heat approaches the LMF on the transfer car on the V-track from the EAF to the LMF. Once the heat arrived at the LMF, the measurement at 10:02 AM showed the liquid steel is 3068° F. with 501 ppm dissolved oxygen. The heat was killed using 603 pounds of aluminum. With strong stirring from both argon plugs, batches of fluxes were added to remove sulfur. Fluxes additions include 3240, 503, 172, 37 pounds of lime, calcium aluminate, slag deoxidizer, and calcium carbide, respectively. After the sulfur removal process and the sample showed 0.0019% sulfur, as shown in Table 2, the heat was arced for 10 minutes to bring the temperature to 3030° F. Then the heat was arced for 4 more minutes to compensate the temperature loss from the final flux additions. The final flux additions include 806 pounds of lime and 203 pounds of slag deoxidizer. The lime was added to thicken the slag and the slag deoxidizer was added to be trapped in the slag and react with oxygen diffused into the slag layer later at the RH when oxygen is blow into the heat. Both measures were taken to minimize sulfur reversion during the later treatment at the RH degasser. The LMF treatment finished at 11:05 AM.

The heat was then shipped to the RH degasser via crane. The vacuum treatment started at 11:37:09 AM. At the RH, the vacuum was pumped down as fast as the system is capable of can as there is no danger splashing of metal inside the vessel that caused by the initial violent carbon-oxygen reaction in un-killed heat in previous process. Higher lifting gas flow was also used from the start, rather than ramp up later in previous process. In embodiments of the present disclosure, 10 to 15 minutes of deep vacuum may be used as the first stage of the vacuum treatment to remove nitrogen. In this particular heat, 15 minutes elapsed from start of the vacuum to the start of oxygen blow. Near the end of that period, a steel sample was taken and analyzed. The carbon, aluminum, and silicon contents from the analysis were fed into a model to calculate the oxygen required for decarburization. The goal was set to control the dissolved oxygen content at the end of decarburization cycle to be 100 ppm to 200 ppm. In some embodiments, the oxygen was also blown in one or two or three batches in order to lower the peak oxygen content in the steel to minimize sulfur reversion. In this particular heat, 172 Nm3 of oxygen was blown into the heat via the top lance in three batches. Near the end of decarburization, the measurement showed 2881° F. with 104 ppm oxygen. The heat was killed at 12:22:47 PM. After alloy additions, the vacuum was broken, and the heat was sent out to the trim station at the RH facility for calcium treatment. Calcium treatment may be used for the heat to be castable on a thin slab caster.

TABLE 2

Carbon, nitrogen, sulfur and titanium change in trial heat 2201684

| Sample Code | Sample Description | C, % | N, % | S, % | Ti, % |
|---|---|---|---|---|---|
| L4 | LMF Final | 0.0374 | 0.0069 | 0.0019 | 0.0007 |
| L6 | RH Pre-Deox | 0.0048 | 0.0027 | 0.0054 | 0.0002 |
| L7 | RH End Vacuum | 0.0029 | 0.0026 | 0.0053 | 0.0010 |
| L8 | After Ca Treat | 0.0020 | 0.0032 | 0.0038 | 0.0013 |
| CC | Caster | 0.0017 | 0.0021 | 0.0031 | 0.0015 |

The carbon, nitrogen, sulfur and titanium content throughout the process are listed in Table 2. For carbon, this trial heat ended 0.0017% at the caster, significantly lower than the 0.0051% average in the previous process. As shown in Table 1 and FIG. 3, there is a large variation in the carbon content among heats made in previous process and the frequency of heats finishing over 0.0034% carbon at the caster, which is the maximum for most high grade NGO steel grade, was over 80%. With various embodiments of the current disclosure, with the elimination of carbon pickup associated with returning the heat to the LMF, it the chances of exceeding the desired carbon maximum of 0.0034% is very low. For nitrogen, this particular heat finished at 0.0021% which is also acceptable for a high performance NGO steel. Some sulfur reversion occurred and the heat finished at 0.0031%. As further improvements were made, much lower sulfur levels were achieved in later trials as shown below. It is worthwhile to point out that titanium content in the steel decreased from 0.0007% in the final LMF sample to 0.0002% in the sample before alloy addition at the RH degasser. Oxygen blowing to remove carbon at the RH is certainly responsible for the titanium decrease. Of course, the titanium content increased later due to alloy addition as shown in Table 2. But that is the result of titanium as residual element in the alloys added into the heat. Controlling titanium pickup from alloys by using alloys that have low titanium content is another subject but the removal of titanium that was reverted into the steel from slag during the prior desulfurization step by oxygen blowing as a step in the embodiment of the present disclosure is certainly an advantage of the present disclosure. This is also apparent comparing the final titanium content in this and the following example with the 0.0022% average in CRML heats produced using the prior art, even though the ferrosilicon addition in the NGO heats are 7-9 times larger than that in the CRML heats.

Example 2—Heat #2202772

This heat was a NGO grade with high silicon, aluminum levels and moderate manganese level. As the contents of alloy elements such as silicon, aluminum, manganese in the NGO grades are not subject to the current disclosure, they are not listed in this disclosure.

Similar to that in the previous example (heat 2201684), after tapping out from the EAF, the heat was killed at the LMF and desulfurized. The final sample at the LMF showed a sulfur of 0.0019%. Near the end of the treatment at the LMF, 800 pounds of lime and 200 pounds of deoxidizer was added into the ladle slag as part of the "slag conditioning" practices to prevent sulfur reversion during the RH treatment.

Figure 2:
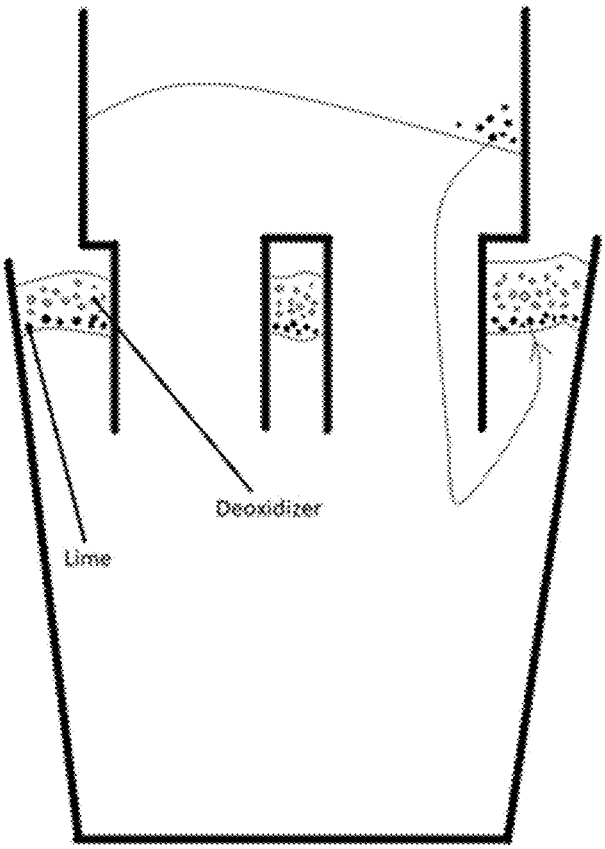
FIG. 2 shows lime addition at the RH degasser piro to oxygen blow to create a lime rich layer at the bottom of the slag layer in the ladle according to an embodiment of the present disclosure.

At the RH degasser, the heat was first subjected to 15 minutes under deep vacuum for nitrogen removal. During that period, 1200 pounds of lime was added into the RH vessel to further condition the ladle slag, especially the bottom layer of the ladle slag, as depicted in FIG. 2, to prevent sulfur reversion later during the oxygen blowing. Following the 15-minute denitrogenization, a total of 181 $Nm^3$ of oxygen was blown into the heat in two batches for decarburization. After decarburization, aluminum, ferrosilicon, and electrolytic manganese were added to achieve the chemistry specifications for the NGO grade. In embodiments of the present disclosure, following the alloy addition, the heat is subject to 5 to 25 minutes of circulation at the RH degasser for inclusion removal. The duration of that step may depend on the schedule of the caster while longer duration is desirable for inclusion removal as well as further removal of nitrogen and to less extent the removal of sulfur in grades with high silicon and aluminum contents. As shown in Table 3, ultra-low levels of carbon, nitrogen, and sulfur levels were achieved in the NGO heat.

TABLE 3

Carbon, nitrogen, sulfur and titanium change in trial NGO heat 2202772

| Sample Code | Sample Description | C, % | N, % | S, % | Ti, % |
|---|---|---|---|---|---|
| L5 | LMF Final | 0.0202 | 0.0099 | 0.0019 | 0.0005 |
| L7 | RH Pre-Deox | 0.0025 | 0.0037 | 0.0028 | 0.0001 |
| L10 | RH Final | 0.0031 | 0.0024 | 0.0021 | 0.0018 |
| CC | Caster Final | 0.0023 | 0.0031 | 0.0018 | 0.0021 |

Example 3—Heats 2203959, 2210022, 2210182, 2210184

Following similar procedures as that in heat 2202772, four more NGO heats with high silicon, aluminum levels and moderate level of manganese were produced. The final caster chemistries on carbon, nitrogen, sulfur, and nitrogen are listed in Table 4.

TABLE 4

Final caster carbon, nitrogen, sulfur, and titanium contents in trial NGO heats

| Heat Number | C, % | N, % | S, % | Ti, % |
|---|---|---|---|---|
| 2203959 | 0.0026 | 0.0023 | 0.0026 | 0.0018 |
| 2210022 | 0.0022 | 0.0039 | 0.0018 | 0.0021 |
| 2210182 | 0.0028 | 0.0012 | 0.0009 | 0.0016 |
| 2210184 | 0.0018 | 0.0021 | 0.0013 | 0.0020 |

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard variation found in their respective testing measurements.

Also, it may be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the disclosure.

Whereas particular embodiments of this disclosure have been described above for purposes of illustration, it will be evident to those skilled in the art that numerous variations of the details of the present disclosure may be made without departing from the disclosure.

What is claimed is:

1. A method of making non-grain oriented (NGO) steel, comprising:

tapping the liquid steel out of an electric arc furnace;

deoxidizing the liquid steel before or after transferring the liquid steel to a ladle metallurgy furnace producing killed deoxidized liquid steel;

removing sulfur at the ladle metallurgy furnace (LMF) producing desulfurized liquid steel;

skimming off ladle slag and/or adding fluxes to the ladle slag at the LMF to prevent sulfur reversion;

transferring the desulfurized and killed deoxidized liquid steel from the LMF to a RH degasser;

removing nitrogen from the desulfurized and killed deoxidized liquid steel at the RH degasser with fast vacuum pump down;

adding fluxes into the RH degasser to fortify a bottom layer of ladle slag transferred from the LMF to the RH degasser against sulfur reversion;

removing carbon by oxygen blowing into the liquid steel at the RH degasser to produce decarburized liquid steel comprising 0.003 weight percent or less carbon; and recirculating the steel at the RH degasser to remove inclusions.

2. The method of making NGO steel of claim 1, wherein the amount of sulfur in the liquid steel is reduced to 0.003 weight percent or less in the LMF.

3. The method of making NGO steel of claim 1, wherein the amount of nitrogen in the liquid steel is reduced to 0.003 weight percent or less in the RH degasser.

4. The method of making NGO steel of claim 3, wherein the low sulfur weight percent obtained at the ladle metallurgy furnace accelerates nitrogen removal at the RH degasser.

5. The method of making NGO steel of claim 1, further comprising removing hydrogen while the liquid steel is in the RH degasser.

6. The method of making NGO steel of claim 1, wherein the oxygen blowing at the RH degasser comprises blowing oxygen through a top lance or tuyeres of the RH degasser.

7. The method of making NGO steel of claim 6, wherein the oxygen blowing at the RH degasser removes aluminum and silicon from the liquid steel through oxidation.

8. The method of making NGO steel of claim 6, wherein the amount of oxygen blown into the RH degasser is controlled such that the oxygen content in the steel is approximately 100 ppm to 200 ppm to prevent sulfur reversion from slag.

9. The method of making NGO steel of claim 6, wherein the oxygen blowing for carbon removal also removes titanium from the liquid steel to a negligible level before alloy additions.

10. The method of making NGO steel of claim 1, further comprising deoxidizing the liquid steel in the RH degasser after the step of removing carbon.

11. The method of making NGO steel of claim 1, further comprising adding alloys to the liquid steel in the RH degasser to achieve chemistry specifications of the NGO steel.

* * * * *